US005386697A

United States Patent [19]

Claudinon et al.

[11] Patent Number: 5,386,697

[45] Date of Patent: Feb. 7, 1995

[54] UNIT FOR CONTROLLING A PLURALITY OF HYDRAULIC ACTUATORS

[75] Inventors: Jean-Louis Claudinon, Andrezieux-Boutheon; André Rousset, St Priest en Jarrez, both of France

[73] Assignee: Marrel, France

[21] Appl. No.: 98,225

[22] Filed: Jul. 27, 1993

[30] Foreign Application Priority Data

Aug. 4, 1992 [FR] France ..... 92 09658

[51] Int. Cl.[6] ..... F15B 13/08

[52] U.S. Cl. ..... 60/420; 91/446; 91/518; 137/596

[58] Field of Search ..... 137/596.13, 596; 60/420; 91/446, 518

[56] References Cited

U.S. PATENT DOCUMENTS 3,987,622 10/1976 Johnson .
4,165,613 8/1979 Bernhoft et al. .
4,617,854 10/1986 Kropp .
4,736,770 4/1988 Rousset et al. .
4,739,617 4/1988 Kreth et al. .
5,150,574 9/1992 Hirata et al. .
5,222,426 6/1993 Marcon et al. .

FOREIGN PATENT DOCUMENTS 2339757 8/1977 France .
2548290 1/1985 France .
2562632 10/1985 France .
4036720 5/1992 Germany .

*Primary Examiner*—Gerald A. Michalsky
*Attorney, Agent, or Firm*—Remy J. VanOphem; John VanOphem

[57] ABSTRACT

Hydraulic actuators are fed by a single flow-rate generator, each being connected to it through a proportional directional valve, the unit including at least one auxiliary valve fed by the flow-rate generator and producing a pressure which is normally equal to a regulation pressure increased by a constant, and in each proportional directional valve an actuating device causes the compensating spool to respond to the pressure produced by the auxiliary valve.

10 Claims, 4 Drawing Sheets

12
56
14
53
38
54
52
13
55
1
70
33
45
44
32
39
37
35
30
34
36
40
42
31
2
62
11
29
43
51
50
3
49
27
23
26
48
28
9
7
5
61
302
301
305
303
306
315
309
304
307
311
310
314
308
312
313
16
72
111
22
4
15
80
24
25
112
121
41
114
46
119
115
125
116
123
126
71
99
73
74
6
8
10

12
14
13
56
53
54
52
55
1
170
62
33
45
44
32
39
37
38
35
30
34
36
40
42
31
2
9
7
5
61
10
4
8
6
29
3
49
48
28
41
11
302
315
303
306
309
301
43
51
300
50
27
92
81
83
116
305
304
307
311
310
314
308
312
313
99
73
74
72
15
180
93
94
91
95
96
146
100
84
98
86
85
87
88
101
102
104
71

UNIT FOR CONTROLLING A PLURALITY OF HYDRAULIC ACTUATORS

BACKGROUND OF THE INVENTION

1. Field of the Invention

The invention relates to a unit for controlling a plurality of hydraulic actuators, through which the actuators are supplied by a single flow-rate generator, each being connected to it through a proportional directional valve.

2. Description of the Prior Art

It is known that directional valves are appliances which are disposed between a flow-rate generator and an actuator in order to control the functioning of the actuator by adapting the way in which it is connected to the flow-rate generator.

Directional valves of the proportional type have not only a controlled spool, the position of which determines the cross section of a throttle, but also an automatic compensating spool for keeping the pressure difference between the upstream and downstream of the throttle constant, so that a given flow-rate of fluid corresponds to a given position of the controlled spool. Consequently, when an actuator is controlled with a proportional directional valve, its speed of operation is determined by the position of the controlled spool, independently of the load which the actuator bears.

When the flow-rate generator is used for supplying a plurality of actuators, with a proportional directional valve corresponding to each of them, it may happen that the total flow-rate demanded by the actuators exceeds the maximum flow-rate which the flow-rate generator is able to supply. The respective compensating spools are then no longer able to maintain, in each of the directional valves, the pressure difference between the upstream and downstream of the throttle at the predetermined constant, so that the most heavily loaded actuators slow down or stop while the less heavily loaded ones are able to continue to operate.

In order to avoid such malfunctioning, it has already been proposed to use the regulation of the flow-rate generator according to the power demanded, which at the present time is provided for on the majority of hydraulic circuits where the flow-rate generator supplies a plurality of actuators. This regulation is achieved by providing load-detection means known as "load sensing", which refer back to the flow-rate generator the pressure of the most heavily loaded actuator, to which pressure the flow-rate generator responds by producing a service pressure equal to the load-sensing pressure increased by a constant. In reality, this constant is added for as long as the total flow-rate demand is less than that capable of being supplied but, in the event of excessive demand, the value added to the load-sensing pressure is smaller than the constant, and the higher the excessive flow-rate demand, the smaller the value. It is this reduction in the value added which is used in order to avoid the aforesaid malfunctioning.

French Patent No. 2,339,757 proposes to act on the actuating pressure of the controlled spool in each of the proportional directional valves, by arranging for the actuating valves to be fed not directly from a pilot pump but rather with the interposing, between the pilot pump and the actuating valves, of an operating margin valve which varies the supply pressure for the control valves in the same way as the difference between the pressure of the flow-rate generator and the load-sensing pressure. As long as the flow-rate generator is operating normally, the supply pressure for the control valves remains constant, just as if these valves were supplied directly by the pilot pump. In the event of an excessive flow-rate demand, the supply pressure for the control valves will decrease as a function of the magnitude of the excessive demand, the actuating pressure of all the controlled spools will decrease in the same way, and consequently all the throttlings produced by the controlled spools will increase in the same way, with the result that each directional valve will have applied to it the same level of flow-rate reduction so that all the actuators will slow down, with preservation of their speed ratio.

French Patent No. 2,548,290 proposes to arrive at the same result where the proportional directional valves have a compensating spool which is located upstream of the controlled spool, by acting on the means of actuating the compensating spool: it continues to be forced in the direction of closing by the pressure upstream of the controlled spool and in the direction of opening by the pressure downstream of the controlled spool, but a double pressure force is substituted for the conventional spring, respectively, in the direction of closing by the load-sensing pressure and in the direction of opening by the pressure of the flow-rate generator. The difference in pressure between upstream and downstream of the throttle of the controlled spool thus depends on the difference between the pressure of the flow-rate generator and the load-sensing pressure, which leads to the aforesaid result.

The invention aims to obtain this same result, but with improved performance.

SUMMARY OF THE INVENTION

The present invention is a unit for controlling a plurality of hydraulic actuators, through which the actuators are supplied by a single flow-rate generator, each being connected to it through a proportional directional valve including:

a controlled spool, the position of which determines the cross section of a first throttle;

a compensating spool for regulating the pressure difference between upstream and downstream of the first throttle by producing, upstream of the latter, a second throttle with an appropriate cross section; and means of actuating the compensating spool, in order to cause it to automatically adopt a position in which it produces the second throttle with an appropriate cross section, in response to several pressures acting respectively in the direction of opening and in the direction of closing.

According to the invention, the unit also includes at least one auxiliary valve fed by the flow-rate generator and producing a pressure which is normally equal to a regulation pressure increased by a constant. In each proportional directional valve the means of actuating the compensating spool are designed so that it is forced in the direction of opening by the pressure downstream of the first throttle and by the pressure produced by a so-called auxiliary valve; and in the direction of closing by the pressure upstream of the first throttle, by the regulation pressure, and by a substantially constant force.

Where the regulation pressure is the load-sensing pressure, the unit according to the invention is distinguished from the one described in the last publication of the prior art cited above by the presence of the auxiliary valve, the pressure produced in which is applied in place of the flow-rate generator pressure.

In reality, in order to produce the prior unit in a practical manner, it would have been convenient to apply to the compensating spool the pressure upstream of the latter rather than the flow-rate generator pressure. When the directional valves are distributed at different positions on a machine, difficulties would however arise since the pressure upstream of the second throttle is not the same in the respective directional valves, because of different head losses between the flow-rate generator and the respective directional valves.

Similar difficulties would also arise with the different directional valves in a control unit situated at a distance from the flow-rate generator, since the head losses between the latter and the unit increase with the flow-rate in the conduit feeding the unit. It could, for example, happen that the controlled spool in one of the directional valves in the unit remains in the same position and that the flow-rate passing in it decreases without the flow-rate capacity being exceeded. This would arise in particular as a result of an increase in the flow-rate passing through a second directional valve because the increase in the total flow-rate feeding the unit causes the head losses between the flow-rate generator and the unit to be increased and therefore the difference between the pressure feeding the unit (that is to say the pressure upstream of the second throttle for all the directional valves in the unit) and the load-sensing pressure to be decreased.

The unit according to the invention enables the known difficulty of the prior art discussed above to be avoided.

The invention also offers the advantage of being able to provide the sought-for result even if the flow-rate generator is not regulated as a function of the load borne by the actuators.

Preferably, for reasons of simplicity and convenience, the auxiliary valve has:

- an inlet chamber connected to the flow-rate generator;
- a regulating chamber in which the regulation pressure prevails;
- an outlet chamber in which the pressure produced prevails;
- a spool, the position of which determines the cross section of a throttle between the inlet chamber and outlet chamber, having a first active surface disposed in the regulating chamber so that the regulation pressure acts in the direction of opening, and a second active surface disposed in the outlet chamber so that the pressure produced acts in the direction of closing; and
- a spring, which acts on the spool in the direction of opening.

Where the proportional directional valves are divided into several groups in a directional valve or several adjacent directional valves, the groups being distant from each other, it is preferable for the unit to have an auxiliary valve adjacent to the group for each group.

In this way the problems related to the line head losses are avoided, and in particular it is not necessary to have to provide a line between the auxiliary valve and a group of directional valves at some distance from the latter.

The disclosure of the invention will now be continued with a detailed description of example embodiments, given below by way of illustration and non-limitatively, with reference to the accompanying drawings appended hereto.

DETAILED DESCRIPTION OF THE PREFERRED EMBODIMENT

Figure 1:
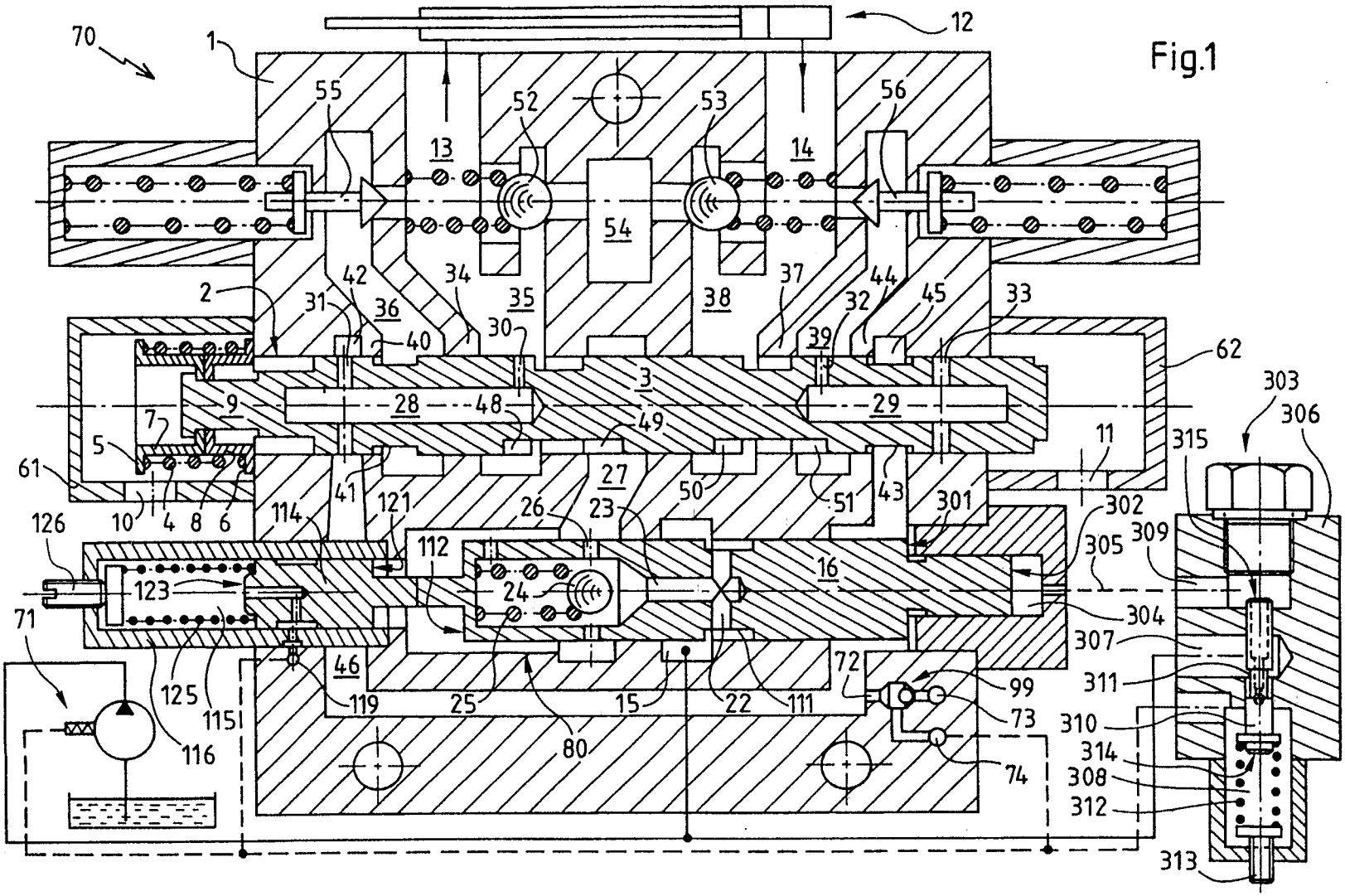
FIG. 1 is a diagrammatic view in cross section of a proportional directional valve forming part of a unit according to the invention.

A directional valve 70 illustrated in FIG. 1 is similar to the one described in French Patent 2,562,632, with the exception of its pressure-compensating device.

It has a stator block 1, in a bore 2 of which slides a cylindrical controlled spool 3. As is usual, the hydraulic circuits are switched by a movement of the grooves of the spool 3 in front of the stator ports.

At its left-hand end, for example, the spool 3 has a spring return device of a known type, including a helical spring 4, compressed between shoulders 5 and 6 of two rings 7 and 8, captive between two shoulders on an end 9 of the spool 3, about which they are able to slide. Thus the spool 3 is spontaneously returned to a neutral position of rest, while it is pushed to the right (FIG. 1) when a pilot pressure is directed into an opening 10 in the fixed cap 61. On the other hand, it is pushed towards the left when a pilot pressure is directed in the opposite direction, into an opening 11 in a cap 62 at its other end. In the example illustrated, it has been assumed that the three-position spool 3 is used to provide control of a double-acting hydraulic cylinder 12. For this purpose, one of the sections of the cylinder 12 is connected to a first utilization duct or conduit 13 in the stator 1, while the opposite section of the cylinder 12 is connected to a second utilization duct or conduit 14 in the stator 1.

The directional valve receives, in an annular inlet chamber 15, the pressure sent by a flow-rate generator 71.

The inlet chamber 15 surrounds a compensating spool 16, also referred to as a balance spool, which is able to move in a bore 80 in the stator 1. The spool 16 has a radial drilling (or duct) 22 communicating with a blind axial drilling 23. The latter opens out onto a seat which is able to be closed off or unblocked by a ball 24, a return spring 25 for which is compressed inside the compensating spool 16. The chamber containing the ball 24 and spring 25 opens out through a lateral opening 26 into an annular chamber 27 surrounding the central part of the controlled spool 3.

At each of its two ends, the controlled spool 3 has an internal axial space, 28 to the left, 29 to the right.

The space 28 communicates with the exterior of the spool through two radial drillings given the reference numerals 30 and 31 respectively. Likewise, the space 29 opens out onto two radial drillings or passages 32 and 33.

When the spool 3 is in its neutral position of rest, the drilling 30 is opposite a solid part 34 of the stator, which closes it off, between two annular chambers 35 and 36.

The chamber 35 communicates with the first utilization conduit 13, while the chamber 36 is connected to the return circuit.

Likewise, the drilling 32 is closed off at rest, by a solid part 37, situated between two annular chambers 38 and 39. The chamber 38 communicates with the second utilization conduit 14, while the chamber 39 is connected to the return circuit.

Between the drillings 30 and 31, the stator defines, in the bore, a solid part 40, in front of which a groove 41 in the spool 3 is able to move.

Around the spool 3, in the zone situated around the drilling 31 when the spool is pushed to the right (FIG. 1), there is an annular stator chamber 42.

Likewise, at its opposite end, the spool 3 has a groove 43 moving in front of a solid part 44 of the stator. Around the passage 33, when the spool 3 is pushed towards the left, there is an annular stator chamber 45.

The two stator chambers 42 and 45 are connected by a conduit 46 referred to as the load-sensing conduit.

The various grooves in the spool are provided with progressiveness notches, as indicated for example by the reference numerals 48, 49, 50 and 51.

Finally, a first prefill valve 52 is mounted in parallel with the first utilization conduit 13. Likewise, a prefill valve 53 is mounted in parallel with the second utilization conduit 14. Behind the prefill valves 52 and 53 is a chamber 54 connected to the oil return circuit.

A pressure relief valve, respectively 55 and 56, is provided on the side of each of the utilization conduits 13 and 14, which are thus able to overflow into the return chambers, respectively 36 and 39.

The operation of the controlled spool 3 will now be described.

In the neutral position, the chambers 27, 35 and 38 are closed off, so that the cylinder 12 is immobilized while no flow is passing in the directional valve. In addition, the conduit 46 communicates, through the grooves 41 and 43, respectively, with the chamber 36 and chamber 39, that is to say it is connected to the return circuit.

When a pilot pressure is directed through the opening 10, as is the case in FIG. 1, the spool 3 slides to the right with an amplitude determined by the value of the pilot pressure, which is balanced with the opposing thrust of the spring 4, which is compressed to a greater or lesser degree. The feed pressure of the chamber 27 is directed into the first utilization conduit 13, passing through the groove (progressiveness notch) 49 and chamber 35, while the second utilization conduit 14 communicates with the return chamber 39 through the groove 51. Each of the grooves 49 and 51 determines a throttle, the cross section of which is determined by the position of the spool 3. In addition, the conduit 46 communicates to the left with the first utilization conduit 13 through the passages 31, 28 and 30, while to the right it is closed off. The pressure downstream of the throttle produced by the groove 49 is thus transmitted to the conduit 46.

When a pilot pressure is directed through the opening 11, the spool 3 slides towards the left as far as a position determined by the amplitude of the pilot pressure. The feed pressure of the chamber 27 is directed into the second utilization conduit 14, passing through the groove 50 and chamber 38, while the first utilization conduit 13 communicates with the return chamber 36, passing through the groove 48. Each of the grooves 48 and 50 determines a throttle, the cross section of which is determined by the position of the spool 3. In addition, the conduit 46 communicates to the right with the second utilization conduit 14 through the drillings 33, 29 and 32, while to the left it is closed off. The pressure downstream of the throttle produced by the groove 50 is thus transmitted to the conduit 46.

It can thus be seen that, in the neutral position, the conduit 46 is subjected to the pressure of the return circuit, while in each of the operating positions it is raised to the pressure downstream of the throttle produced by the spool 3 on the supply line to the cylinder 12, that is to say to the utilization pressure of the latter.

One of the inlets to the circuit selector 99 (also referred to as the OR function) communicates with the conduit 46 through a duct 72, and its other inlet communicates with a duct 73 connected to the outlet conduit from the circuit selector of a similar directional valve. In this case, the pressure in the conduit 46 is the strongest, so that the circuit selector 99 adopts the position illustrated, in which it transmits, through its outlet to a conduit 74, the utilization pressure of the cylinder 12, which is the highest utilization pressure of all the actuators fed by the flow-rate generator 71. More generally, as can be seen clearly in FIG. 2, it is always the pressure of the most heavily loaded actuator which is applied to the conduit 74, this so-called load-sensing pressure being transmitted to the flow-rate generator 71, which produces a service pressure which is normally equal to the load-sensing pressure increased by a constant.

The compensating spool 16 has, around the duct 22, a groove 111 which produces, depending on the position of the spool, a throttling to a greater or lesser degree upstream of the throttle produced by the spool 3 on the supply line to the cylinder 12, depending on the position adopted by the compensating spool 16.

The latter has two active surfaces, to the left a surface 112 subjected to the pressure upstream of the throttle produced by the spool 3, and to the right a surface 301 subjected to the pressure prevailing in the conduit 46, that is to say the utilization pressure of the cylinder.

On the left-hand side of the compensating spool 16 is disposed a piston 114 able to move coaxially, which comes into contact with the compensating spool through a stud, and slides in a cylinder 116 screwed into the stator 1 coaxially with the bore 80, the cylinder 116 being open to the inner side and closed on the outer side and passing sealingly through the conduit 46.

The piston 114 has an L-shaped passage which enables a chamber 115 situated between the piston and the end of the cylinder to be put in communication with a conduit 119, which is connected to the flow-rate generator load-sensing duct, so that it is subjected to the load-sensing pressure. The piston 114 has two opposite surfaces, a surface 121 facing the active surface 112 of the compensating spool 16 and subjected to the same pressure, and an active surface 123 subjected to the load-sensing pressure.

A spring 125, the force of which is adjustable with a screw 126, presses the piston 114 against the compensating spool 16.

To the right the compensating spool has a third active surface 302 which is subjected to the pressure produced by an auxiliary valve 303.

The surfaces 301 and 302 face towards the right, and the pressures to which they are subjected force the compensating spool 16 in the direction of opening.

The surface 301 is subjected to the pressure prevailing downstream of the throttle produced by the spool 3 since it is disposed in the conduit 46, and the surface 302 is subjected to the pressure produced by the auxiliary valve 303 since it is disposed in a chamber 304 connected to the valve 303 by a conduit 305.

The surfaces 112 and 123 face towards the left, and the pressures to which they are subjected therefore force the compensating spool 16 in the direction of closing. The surface 121, facing towards the right, forces the piston 114 to the left, that is to say everything occurs as if the pressure upstream of the throttle produced by the spool 3 were applied over the effective area of the surface 112 decreased by the effective area of the surface 121. The effective value of this difference between active surfaces, which for convenience will be referred to as the "size of the active surface 112," will be termed $S_2$, and the effective area of the active surface 123 will be termed $S_1$.

The effective area of the active surface 301 is also $S_2$, and that of the active surface 302 is $S_1$.

If the force applied by the spring 125 is also termed F, the pressure prevailing upstream of the throttle produced by the controlled spool 3 is termed $P_i$, the load-sensing pressure is termed $P_{1s}$, the pressure prevailing downstream of the throttle produced by the controlled spool 3 is termed $PU_i$, and the pressure produced by the auxiliary valve 303 is termed $P_p$, it can be demonstrated that at equilibrium:

$$P_i - PU_i = \frac{S_1}{S_2}(P_p - P_{1s}) - \frac{F}{S_2}$$

It can be seen that the pressure difference $P_i - PU_i$ depends on the pressure difference $P_p - P_{is}$ in accordance with a linear function with a strictly positive coefficient and strictly negative constant.

The auxiliary valve 303 has a stator body 306 defining an inlet chamber 307 connected to the output orifice of the flow-rate generator 71; a regulating chamber 308 in which $P_{1s}$ prevails; an outlet chamber 309 in which the pressure produced prevails; a spool 310, the position of which determines, by virtue of a groove 311, the cross section of a throttle between the chambers 307 and 309; a spring 312 which acts on the spool 310 in the direction of opening, and a screw 313 which is provided to regulate the force with which the spring acts.

$P_{1s}$ prevails in the chamber 308, since this chamber is connected to the conduit 74.

The spool 310 has a first active surface 314 disposed in the regulating chamber 308 and therefore subjected, in the direction of opening, to $P_{1s}$, and a second active surface 315 disposed in the outlet chamber 309, which means the pressure produced acts on the second active surface 315 in the direction of closing. It can be demonstrated, where the effective area of the surfaces 314 and 315 is similar, and if this value is termed S and the force exerted by the spring is termed F, that this gives:

$$P_p = P_{1s} + \frac{F}{S}$$

The pressure produced is therefore normally independent of the pressure supplied by the flow-rate generator.

Where the proportional directional valves in the control unit are divided into several groups of one directional valve or several adjacent directional valves, the groups being distant from each other, for example in the case of a civil engineering machine, divided into a first group of two directional valves controlling the right and left-hand forward-travel motors of the vehicle, a second group of a single directional valve controlling the rotation of a turret, and a third group of several directional valves controlling the different arms of the machine, it is preferable to provide an auxiliary valve for each of the groups, not only in order to avoid the problems of head loss but also to avoid having to provide a conduit between a centralized auxiliary valve and the different groups.

Figure 2:
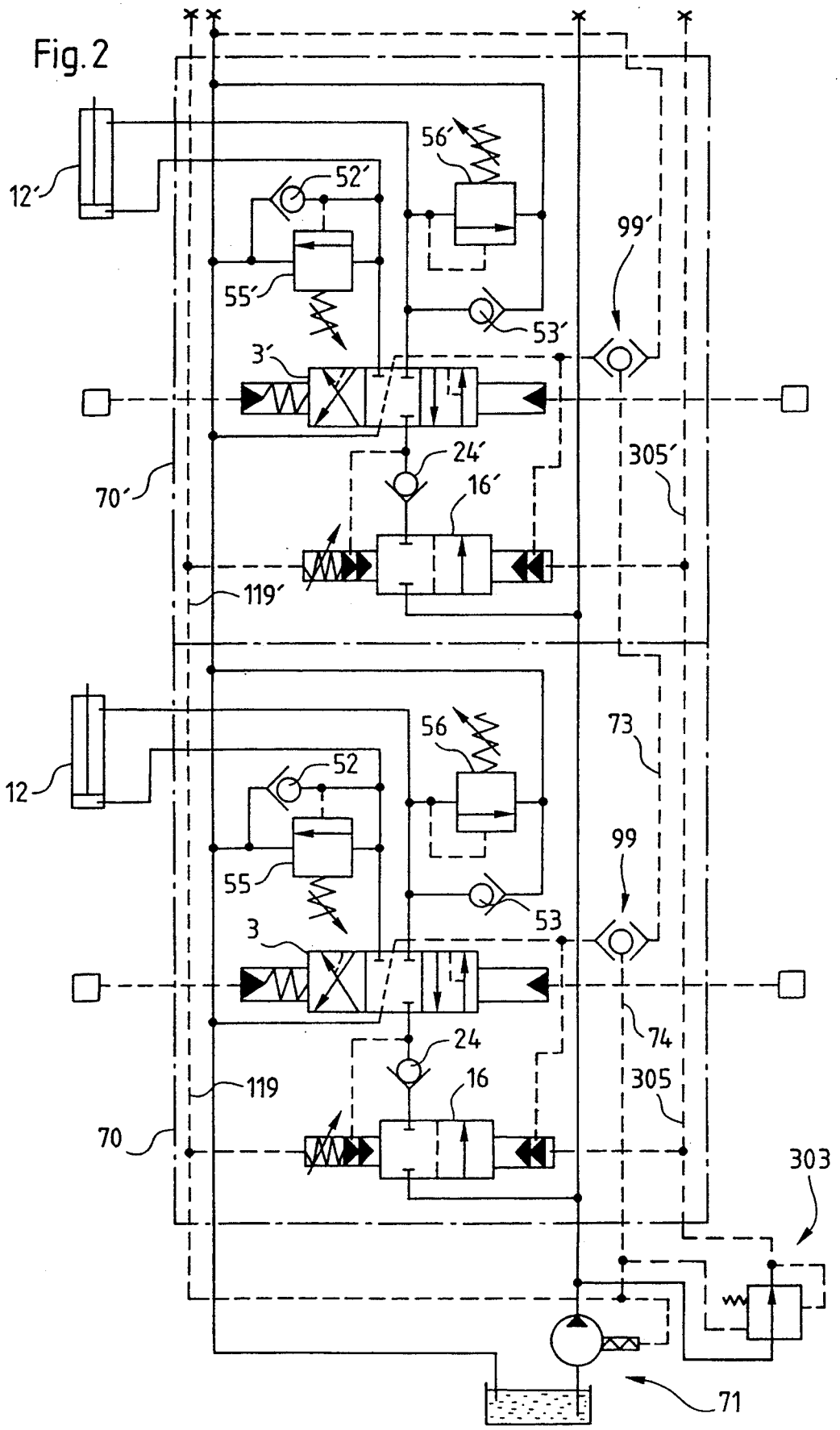
FIG. 2 is a diagram of a hydraulic circuit embodying the control unit, which includes two directional valves similar to the one shown in FIG. 1, joined end to end.

FIG. 2 shows a control unit according to the invention, formed by a single group of two directional valves joined together, respectively, the directional valve 70 illustrated in FIG. 1 and an identical directional valve 70', all the components of the latter bearing the same reference numerals as the directional valve 70 but given a prime suffix.

It will be noted that the conduits 73 and 74 form, with the circuit selector 99, an assembly which passes right through the directional valve 70, and that the same applies to the conduits 119 and 305, so that there is a facility for making connections between directional valves, simply by joining the latter end to end.

Figure 3:
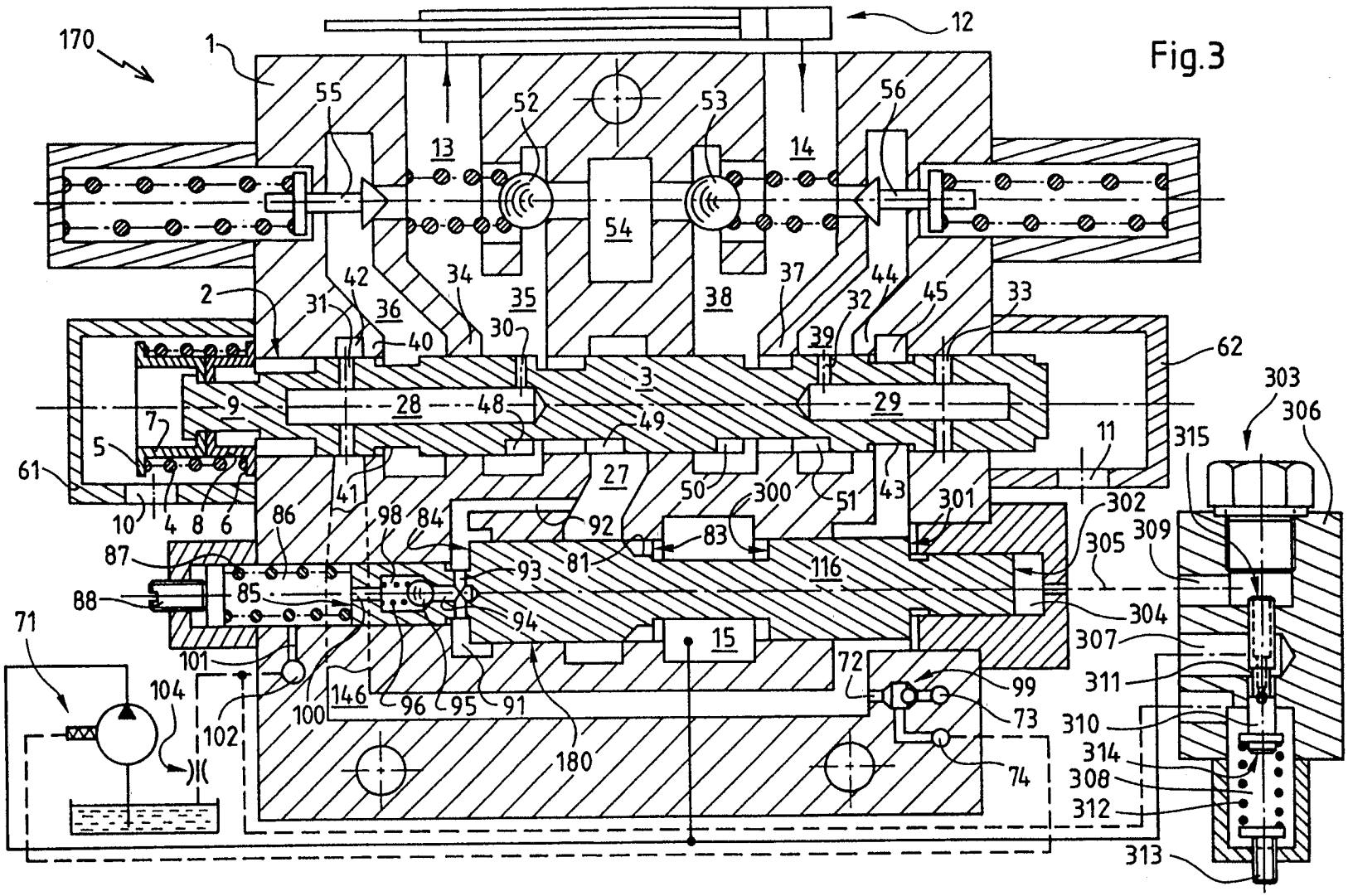
FIGS. 3 and 4 are similar to FIGS. 1 and 2, respectively, of an alternate embodiment of the invention.
Figure 4:
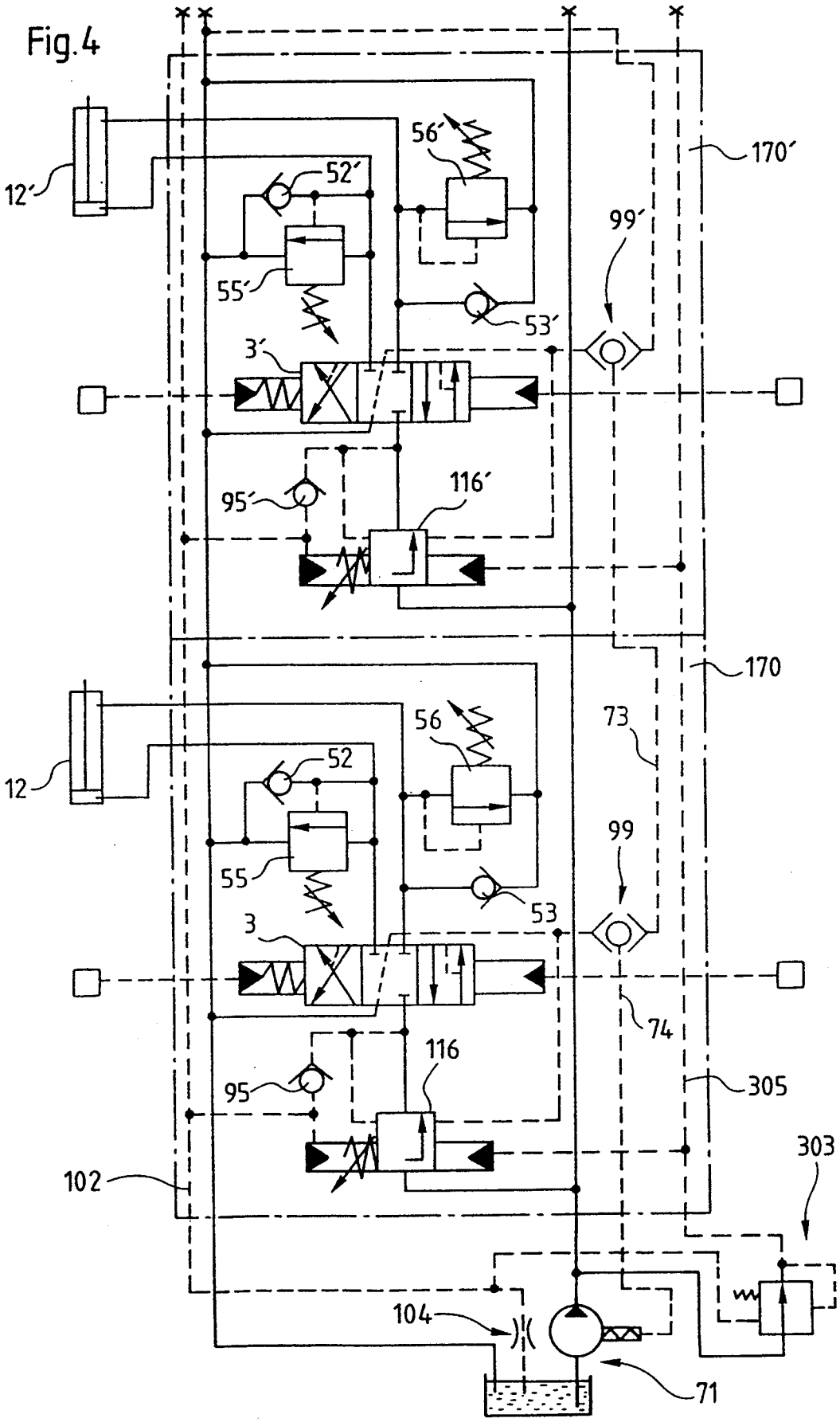

In the variant of the control unit according to the invention shown in FIGS. 3 and 4, the same numerals have been kept for identical components while the FIG. 100 has been added to them for similar components.

The proportional directional valve 170 shown in FIG. 3 includes a compensating spool 116, the left-hand part of which is different from that of the spool 16. In the position illustrated in FIG. 3, the compensating spool 116 closes off the passage between the chambers 15 and 27, but when it moves towards the left it produces, depending on its position, a greater or lesser degree of throttling upstream of the throttle produced by the spool 3 on the supply line to the cylinder 12.

The spool 116 has two surfaces 83 and 300 subjected to the pressure upstream of the throttle produced by the spool 116, an active surface 84 subjected to the pressure upstream of the throttle produced by the spool 3, and an active surface 85 subjected to the pressure prevailing in a chamber 86 situated to the left of the spool 116.

The surfaces 83 and 300 are opposite one another and are of the same size, and the spool 116 therefore does not react to the same pressure upstream of the throttle which it produces.

The surfaces 84 and 85 face towards the left. Since the spool 116 closes off the throttle which it produces when it moves from left to right and vice-versa, the pressures to which the surfaces 84 and 85 are subjected force it in the direction of closing. A spring 87 is provided in the chamber 86 between the end of the chamber, situated to the left, and the surface 85, which means that the spool 116 is also forced in the direction of closing by a substantially constant force. In order to regulate the spool, a screw 88 is provided which forms the end of the chamber 86.

The surface 84 is subjected to the pressure prevailing downstream of the throttle produced by the spool 3 since it is disposed in a chamber 91 communicating with the chamber 27 through a duct 92.

The spool 116 has a radial drilling or passage 93 communicating with a blind axial drilling 94, which opens out onto a seat able to be closed off or unblocked by a ball 95, a return spring 96 for which is compressed in a chamber 98, which opens out through an axial opening 100 into the chamber 86. The chamber 86 communicates, through a passage 101, with a conduit 102 closed at one end and opening out into the reservoir of the flow-rate generator through a restriction 104 at the other end, the conduit 102 being common to all the directional valves, the chambers of which correspond to 86, which is connected thereto.

It can be seen in FIG. 4 that, for each directional valve 170 and 170', the common conduit 102 is connected to the upstream of the throttle produced by the spool 3 through a nonreturn valve, the ball 95 of which forms the seal, this nonreturn valve passing fluid in the direction of the conduit 102. Consequently, in the latter, the highest of the pressures prevailing upstream of the throttles produced by the spools 3 and 3' prevails, the restriction 104 producing a pressure drop in the duct 102 which enables the latter to be adjusted continuously to the highest of the pressures upstream of the spools 3 and 3'. It is therefore the latter pressure which prevails in the chamber 86 and in the corresponding chamber in the directional valve 70'.

It is also the latter pressure which prevails in the regulating chamber 308, since in this case it is connected to the conduit 102.

In the example illustrated, the surface 84 has a similar size to the surface 301, that is to say $S_2$, and the surface 85 has a similar size to the surface 302, that is to say $S_1$.

Because of the arrangement and sizing of the surfaces 84 and 85, the action of the load-sensing pressure has in fact been replaced by the highest of the pressures prevailing upstream of the throttle produced by the controlled spool in the respective spools, termed $MAX(P_i)$.

Provided that $P_{1s}$ is replaced by $MAX(P_i)$, the equations given previously apply to the variant shown in FIGS. 3 and 4.

It will be noted that there is no nonreturn valve in the directional valve 170 between the chambers 15 and 27, unlike the directional valve 70.

In fact, it is certain that, at rest, when all the controlled spools 3 are in the neutral position, all the compensating spools 16 are in the closed position illustrated. If the same notations are kept as before, and if the outlet pressure of the flow-rate generator is termed P, observing that $P_p$ is at least equal to P and that, at rest, $P_i=P$ in all the directional valves, even if the spool 16 is closed because of the minute leaks between the upstream and downstream of the latter which are inevitable, it can be seen that the spool 16 is forced in the direction of closing by:

$$F+P.S_1+P.S_2$$

and in the direction of opening by:

$$P.S_1.$$

Given that $F+P.S_2$ is strictly positive, it can be certain that the forces acting in the direction of closing will always be greater than those acting in the direction of opening.

In service, in each of the units illustrated, where the total flow-rate demand of the hydraulic cylinders 12 and 12' exceeds the flow-rate capable of being provided by the flow-rate generator 71, the speed ratios between actuators is maintained since, in the event of an excessive flow-rate demand, the inlet chamber 307 is not fed at a sufficient pressure for F/S to be added to $P_{1s}$ or to $MAX(P_i)$, and it is only a lower value which is added, and the greater the excessive flow-rate demand the smaller is this value.

The values $S_1$, $S_2$ and F are chosen notably as a function of the following essential requirements:

the spool 16 or 116 must provide, in normal service, where $P_p-MAX(P_i)$ or $P_p-P_{1s}=a$, a value b at $P_i-PU_i$, such that:

$$b=\frac{S_1}{S_2}a-\frac{F}{S_2}$$

the spool 16 or 116 must close at a certain minimum value c of $P_p-MAX(P_i)$ or $P_p-P_{1s}$, beyond which it is considered that the overload is too great for the speed ratios between the actuators to be maintained, such that:

$$S_1.c=F.$$

It is possible, depending on circumstances, to choose a regulation pressure other than $MAX(P_i)$ or the load-sensing pressure. In these variants, the advantages of the use of an auxiliary valve are retained.

It will be apparent to those skilled in the art that variations and modifications may be made to the present invention without departing from the scope of the claims appended hereto.

What is claimed is:

1. A unit for controlling a plurality of hydraulic actuators supplied by a single flow-rate generator comprising a plurality of proportional directional valves, each hydraulic actuator of said plurality of hydraulic actuators being connected to said flow-rate generator through a corresponding one of said proportional directional valves, each of said proportional directional valves comprising:

a controlled spool, the position of said controlled spool determining a cross section of a first throttle;

a compensating spool for regulating a pressure difference between upstream and downstream of said first throttle by producing upstream, a second throttle with an appropriate cross section; and means for actuating said compensating spool, in order to cause said compensating spool to automatically adopt a position in which said compensating spool produces said second throttle with an appropriate cross section, in response to several pressures acting respectively in a direction of opening and in a direction of closing; and said unit further comprising at least one auxiliary valve fed by said flow-rate generator and producing a pressure which is normally equal to a regulation pressure increased by a constant, and in each of said proportional directional valves, said means for actuating said compensating spool being forced in the direction of opening by the pressure downstream of said first throttle and by the pressure produced by said at least one auxiliary valve and in the direction of closing by the pressure upstream of said first throttle, by said regulation pressure, and by a substantially constant force.

2. The unit according to claim 1, wherein said means for actuating said compensating spool include a first active surface subjected to the pressure downstream of said first throttle, a second active surface subjected to the pressure produced by sad at least one auxiliary valve, a third active surface subjected to the pressure upstream of said first throttle, and a fourth active surface subjected to said regulation pressure, said first and second active surfaces being opposite said third and fourth active surfaces, and a spring forcing said compensating spool in the direction of closing.

3. The unit according to claim 2, wherein said first and third active surfaces of said compensating spool have similar sizes, and said second and fourth active surfaces of said compensating spool have similar sizes.

4. The unit according to claim 1, wherein said at least one auxiliary valve comprises:

an inlet chamber connected to said flow-rate generator;

a regulating chamber in which said regulation pressure prevails;

an outlet chamber in which said pressure produced prevails;

a spool, the position of said spool determining a cross section of a third throttle between said inlet chamber and said outlet chamber, said spool having a first active surface disposed in said regulating chamber so that said regulation pressure acts in the direction of opening, and a second active surface disposed in said outlet chamber so that said pressure produced acts in the direction of closing; and a spring which acts on said spool in the direction of opening.

5. The unit according to claim 1, wherein said plurality of proportional directional valves are divided into several groups of one proportional directional valve or several adjacent proportional directional valves, said groups being distant from each other, at least one auxiliary valve adjacent each of said groups.

6. The unit according to claim 1, including means for detecting a load sensing pressure in the most loaded hydraulic actuator of said plurality of hydraulic actuators and said regulation pressure being equal to the said load sensing pressure.

7. The unit according to claim 6, wherein said load-detection means includes, for each of said proportional directional valves, a conduit which connects the upstream of said first throttle to at least one circuit selector, and in that, where there are several of them, said at least one circuit selector being disposed in a cascade.

8. The unit according to claim 1, including means for detecting the highest of the pressures prevailing upstream of said first throttle in the respective said proportional directional valves and said regulation pressure being the highest of the upstream pressures thus detected.

9. The unit according to claim 8, wherein each of said proportional directional valves lacks a non-return valve between said second throttle and said first throttle.

10. The unit according to claim 8, wherein said means for detecting the highest of the pressures upstream of said respective first throttles include a common conduit closed at a first end and opening out into a reservoir through a restriction at a second end, each of said proportional directional valves having a non-return valve disposed so as to pass fluid between the upstream of said respective first throttles throttle 8 and said common conduit.

* * * * *

UNITED STATES PATENT AND TRADEMARK OFFICE

CERTIFICATE OF CORRECTION

PATENT NO. : 5,386,697
DATED : February 7, 1995
INVENTOR(S) : Jean-Louis Claudinon and Andre Rousset It is certified that error appears in the above-indentified patent and that said Letters Patent is hereby corrected as shown below:

Column 8, line 24, delete "FIG." insert ---- figure ----.

Column 10, line 64, delete "sad" insert ---- said ----.

Column 12, line 28, delete ---- throttle 8 ----.

Signed and Sealed this

Eighteenth Day of April, 1995

Bruce Lehman

*Attest:*

BRUCE LEHMAN

*Commissioner of Patents and Trademarks*

*Attesting Officer*